US010283095B1

(12) United States Patent
Mobley

(10) Patent No.: US 10,283,095 B1
(45) Date of Patent: May 7, 2019

(54) INDIVIDUALLY CUSTOMIZED MUSICAL INSTRUMENT SUPPORTS, CUSTOMIZED ELEMENTS AND METHODS FOR FORMING THE SAME

(71) Applicant: David Mobley, LLC, Niskayuna, NY (US)

(72) Inventor: David P. Mobley, Niskayuna, NY (US)

(73) Assignee: David Mobley, LLC, Niskayuna, NY (US)

( * ) Notice: Subject to any disclaimer, the term of this patent is extended or adjusted under 35 U.S.C. 154(b) by 16 days.

(21) Appl. No.: 15/800,598

(22) Filed: Nov. 1, 2017

Related U.S. Application Data

(62) Division of application No. 15/064,212, filed on Mar. 8, 2016, now Pat. No. 9,812,100.

(60) Provisional application No. 62/130,282, filed on Mar. 9, 2015.

(51) Int. Cl.
*G10D 3/18* (2006.01)
*G10G 5/00* (2006.01)

(52) U.S. Cl.
CPC ..... *G10D 3/18* (2013.01); *G10G 5/005* (2013.01)

(58) Field of Classification Search
CPC ..... G10D 3/18; G10G 5/005
See application file for complete search history.

(56) References Cited

U.S. PATENT DOCUMENTS

| | | | |
|---|---|---|---|
| 439,199 | A | 10/1890 | Schuster |
| 849,961 | A | 4/1907 | Becker |
| 920,144 | A | 5/1909 | Hughes |
| 931,251 | A | 8/1909 | Beisheim |
| 1,023,234 | A | 4/1912 | Williams |
| 1,387,216 | A | 8/1921 | Wallace |
| 1,435,280 | A | 11/1922 | Colbentson |
| 1,473,672 | A | 11/1923 | Dittman |
| 1,760,593 | A | 5/1930 | Gosparlin |
| 1,821,811 | A | 9/1931 | Mai |
| 2,472,754 | A | 6/1949 | Mead |

(Continued)

FOREIGN PATENT DOCUMENTS

| | | |
|---|---|---|
| EP | 0353824 | 2/1990 |
| FR | 2635218 | 2/1990 |
| GB | 190805289 | 5/1908 |

OTHER PUBLICATIONS

Declaration by David Mobley of Mar. 8, 2016, 6-pages.

(Continued)

*Primary Examiner* — Robert W Horn
(74) *Attorney, Agent, or Firm* — Heslin Rothenberg Farley & Mesiti P.C.

(57) ABSTRACT

A customized musical instrument support for use in supporting a musical instrument on or against a portion of an instrument player's body, includes a universal component having a standardized configuration and attachable to various sized single-type instruments for use by multiple instrument players, and an individually customized element attachable to the universal component. The individually customized element has an individually customized surface contoured corresponding to an impression to substantially fit to the instrument player's contoured body surface which is in proximity to placement of the customized musical instrument support on the instrument player during playing of the musical instrument.

23 Claims, 20 Drawing Sheets

(56) References Cited

U.S. PATENT DOCUMENTS

| | | | | |
|---|---|---|---|---|
| 3,830,896 | A | 8/1974 | Flicker et al. | |
| 3,896,694 | A | 7/1975 | Goldner | |
| 3,897,376 | A | 7/1975 | Lampe | |
| 3,962,395 | A | 6/1976 | Hagglund | |
| 4,347,213 | A | 8/1982 | Rogers, Jr. | |
| 4,506,582 | A | 3/1985 | Goldner | |
| 4,534,259 | A | 8/1985 | Wolf | |
| 4,587,288 | A | 5/1986 | Maxson et al. | |
| 4,615,856 | A | 10/1986 | Silverman | |
| 4,719,835 | A * | 1/1988 | Biasini | G10D 3/18 84/279 |
| 4,890,885 | A | 1/1990 | Grossmann | |
| 4,906,425 | A | 3/1990 | Poussou | |
| 4,951,541 | A | 8/1990 | McMillan | |
| 5,270,474 | A | 12/1993 | Kun | |
| 5,780,756 | A | 7/1998 | Babb | |
| 613,513 | A | 11/1998 | Hoffman | |
| 6,239,337 | B1 | 5/2001 | Stein | |
| 6,278,044 | B1 | 8/2001 | Ruan | |
| 6,667,430 | B1 | 12/2003 | Liao | |
| 6,713,001 | B1 | 3/2004 | Cannon et al. | |
| 6,733,710 | B2 | 5/2004 | Lewis | |
| 7,334,844 | B2 | 2/2008 | Barackman et al. | |
| 7,476,789 | B1 * | 1/2009 | Federici | G10D 3/18 84/270 |
| 7,549,232 | B2 | 6/2009 | Tadin | |
| 7,576,274 | B1 | 8/2009 | Frisch et al. | |
| 8,014,001 | B2 | 9/2011 | Trenkenschu | |
| 8,618,392 | B2 | 12/2013 | Korfker | |
| 8,808,598 | B1 | 8/2014 | Meyer | |
| D717,366 | S | 11/2014 | Korfker | |
| 8,957,294 | B2 | 2/2015 | Toyonaga | |
| 9,153,214 | B2 | 10/2015 | Korfker | |
| 9,305,528 | B1 | 4/2016 | Chen | |
| 9,336,757 | B2 | 5/2016 | Chen | |
| 9,812,100 | B1 * | 11/2017 | Mobley | G10D 3/18 |
| 2005/0116380 | A1 | 6/2005 | Tadin | |
| 2007/0175309 | A1 | 8/2007 | Buttemer | |
| 2012/0126450 | A1 | 5/2012 | Van Berkum et al. | |
| 2012/0280421 | A1 | 11/2012 | Keating et al. | |
| 2013/0035624 | A1 | 2/2013 | Mroz | |
| 2014/0090539 | A1 | 4/2014 | Korfker | |
| 2017/0140742 | A1 | 5/2017 | Kimura | |

OTHER PUBLICATIONS

Pirastro KorfkerRest, available from Pirastro GmbH, Germany, printout available online on Feb. 18, 2016, at http://www.pirastro.com/public_pirastro/pages/en/Pirastro-KorikerRest-00001/, 3-pages, at least as early as Mar. 23, 2015.

Pirastro KorfkerCradle, available from Pirastro GmbH, Germany, printout available online on Feb. 18, 2016, at http://www.pirastro.com/public_pirastro/pages/en/Pirastro-KorfkerCradle-00001/, 3-pages, at least as early as Sep. 19, 2015.

The Impressionist Chinrest, available from Shar Products Company, Ann Arbor, MI 48104, printout available online on Feb. 18, 2016, at http://www.sharmusic.com/Accessories/Chinrests/The-Impressionist-Chinrest-Comforter---Black-Large.axd, 2-pages, at least as early as May 2008.

Teamwork Handcrafts Kryssrest, available from Teamwork Handcrafts, Australia, printout available online on Feb. 22, 2016, at http://www.teamworkhandcrafts.com.au/music.html, 1-page, at least as early as Sep. 12, 2009.

Custom Violin Shoulder Rest Forms to Your Shoulder, printout available online on Feb. 22, 2016, at http://news.thinkns.com/custom-violin-shoulder-rest-forms-to-your-shoulder/, 3-pages, at least as early as Jun. 8, 2010.

Huijben et al., Vacuumatics: Shaping Space by "Freezing" The Geometry of Structures, Proceedings of the International Conference on Tectonics 2007, Eindhoven, The Netherlands, pp. 1-11, Dec. 10-11, 2007.

* cited by examiner

INDIVIDUALLY CUSTOMIZED MUSICAL INSTRUMENT SUPPORTS, CUSTOMIZED ELEMENTS AND METHODS FOR FORMING THE SAME

CLAIM TO PRIORITY

This application is a divisional of U.S. patent application Ser. No. 15/064,212, filed Mar. 8, 2016, entitled "Individually Customized Musical Instrument Supports, Customized Elements And Methods For Forming The Same", which application claims the benefit of U.S. Provisional Application No. 62/130,282, filed Mar. 9, 2015, the entire subject matter of these applications being incorporated herein by reference.

FIELD OF THE DISCLOSURE

This disclosure relates generally to support devices for use with musical instruments, and more specifically, to individually customized musical instrument supports, individually customized elements, and apparatus and methods for forming the same.

BACKGROUND

Musicians often use supports or rests between their instruments and their bodies to improve comfort while playing and to improve control of their instruments. Typically, musical instrument supports or rests provide mechanisms or other means to adjust the support for individual instruments or players. The adjustment mechanisms are usually able to accommodate the typical sizes of a particular instrument they are designed for, such as a violin, and to some degree adjust to the body sizes of individual players.

SUMMARY

Shortcomings of the prior art are overcome and additional advantages are provided through the provision, in one embodiment, of an individually customized musical instrument support which includes, for example, a universal component and an individually customized element. The universal component is releasably attachable to various sized single-type musical instruments. The universal component includes a rigid structural portion having a surface disposable adjacent to a musical instrument player's body in proximity to placement of the individually customized musical instrument support on the musical instrument player during playing of a musical instrument, and means for releasably attaching the rigid structural portion to the various sized single-type musical instruments. The individually customized element includes a first portion having an individually customized resilient contoured surface corresponding to an impression of the portion of the instrument player's body on which the individually customized musical instrument support is disposed during playing of the musical instrument, and a second portion attached to the rigid structural portion of the universal component.

In another embodiment, an individually customized element is provided for use in supporting or resting a musical instrument on a portion of an instrument player's body during playing of the musical instrument. The individually customized element includes, for example, a first portion having an individually customized, resilient, contoured surface corresponding to an impression of a portion of a musical instrument player's body on which the individually customized musical instrument element is disposed during playing of the musical instrument, and a second portion attachable to a universal component attachable to various sized single-type musical instruments to form an individually customized musical instrument support.

In another embodiment, an apparatus is provided for making a customized impression of the contours of a portion of a musical instrument player's body for use in forming an individually customized musical instrument support. The apparatus includes, for example, a shape-conforming bag of controllable rigidity having an impermeable, flexible, and elastically extensible material containing a free-flowing granular material and a fluid, the shape-conforming bag having a first surface disposable adjacent to an area of the instrument player's body in proximity to placement of the individually customized musical instrument support on the instrument player during playing of a musical instrument, a port sealed to the bag, which allows for flow of fluid into or out of the bag while containing the granular material inside the bag, a valve, either integral to the port or connected to the port, to allow and inhibit fluid flow through the port, and a platform component attachable to a second surface of the shape-conforming bag and attachable to the musical instrument.

In another embodiment, a method is provided for forming an individually customized musical instrument support. The method includes, for example, providing an apparatus having a shape-conforming bag of controllable rigidity and a platform component, attaching the platform component of the apparatus to a musical instrument, adjusting the assembly of the musical instrument and apparatus such that the musical instrument is in a playing position and a surface of the shape-conforming bag contacts and conforms to a portion of a musical instrument player's body, removing fluid from the bag to change the bag to a generally rigid state to obtain an impression of the portion of the instrument player's body, removing the apparatus from the instrument player's body and from the musical instrument, scanning the contoured shape of the bag of the impression of the portion of the instrument player's body, creating an electronic model of an individual customized element of an instrument support from the scanned contoured shape of the impression of the portion of the instrument player's body, fabricating a resilient customized element having an individually customized resilient contoured surface corresponding to the impression of the portion of the instrument player's body using the electronic model, and a surface attachable to a universal component releasably attachable to various sized single-type musical instruments, and attaching the surface attachable to a universal component to a universal component to form the individually customized musical instrument support.

In another embodiment, a customizable musical instrument support is provided. The musical instrument support includes, for example, a universal component releasably attachable to various sized single-type musical instruments. The universal component includes a rigid structural portion having a surface disposable adjacent to a musical instrument player's body in proximity to placement of the customizable musical instrument support on the musical instrument player during playing of the musical instrument, and means for releasably attaching the rigid structural portion to various sized single-type musical instruments. The musical instrument support further includes, for example, at least one shape-conforming bag of controllable rigidity having an impermeable and flexible material containing a free-flowing granular material and a fluid, a port operably attached to the bag to allow flow of fluid into or out of the bag, a valve for operable sealing fluid in the bag with the bag attached to the universal component, the bag having a customizable surface shapeable to substantially conform to the musical instrument player's contoured body surface which is in proximity to placement of the customizable musical instrument support on the musical instrument player during playing of the musical instrument, and the bag is changeable from a moldable state into a generally rigid state.

Additional features and advantages are realized through the concepts of the present disclosure. Other embodiments and features of the disclosure are described in detail herein and are considered a part of the claims.

BRIEF DESCRIPTION OF THE DRAWINGS

Various embodiments of the present disclosure are particularly pointed out and distinctly claimed as examples in the claims at the conclusion of the specification. The foregoing and other objects, features, and advantages of the disclosure are apparent from the following detailed description taken in conjunction with the accompanying drawings in which:

DETAILED DESCRIPTION

Figure 1:
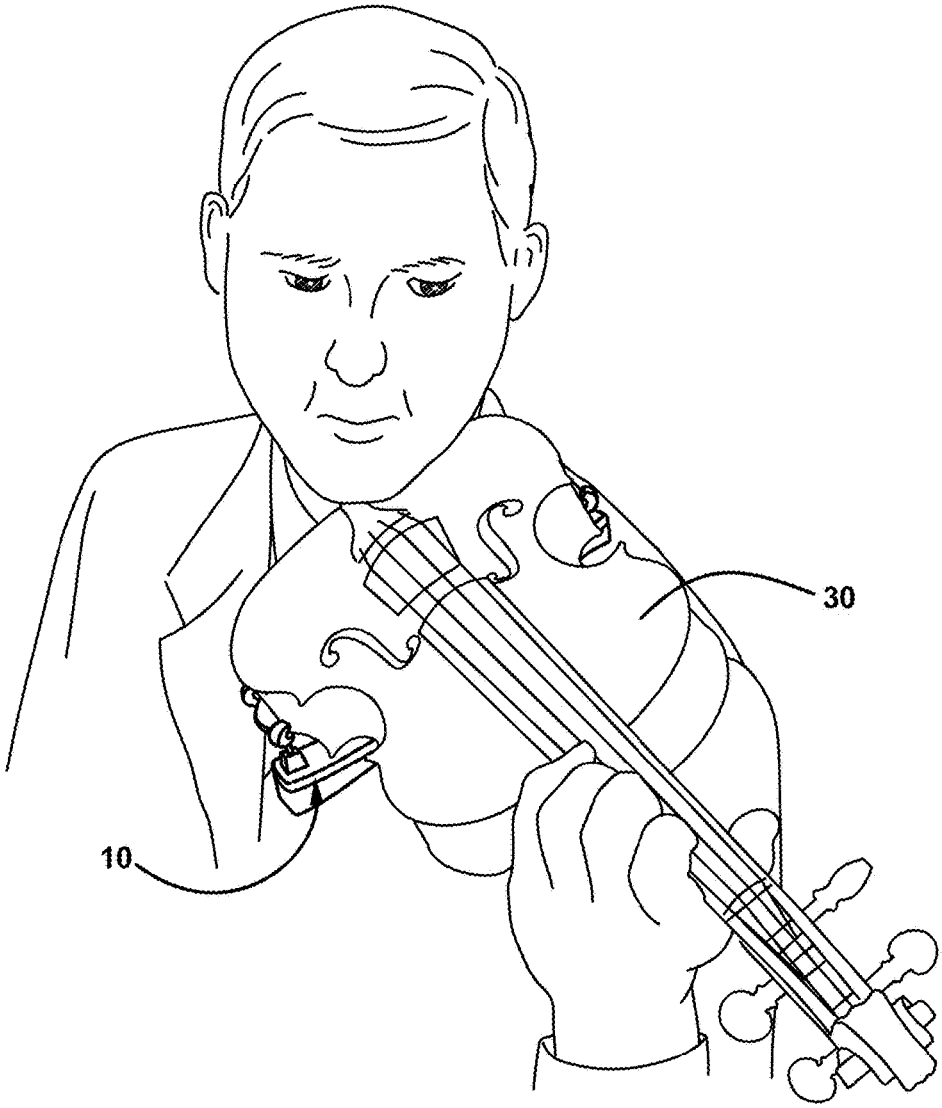
FIG. 1 is a perspective view of an individually customized musical instrument support according to an embodiment of the present disclosure, illustrating a violin shoulder rest.

FIG. 1 illustrates an individually customized musical instrument support 10 according to an embodiment of the present disclosure, for use in supporting a musical instrument 30 on or against a portion of a musical instrument player's body. For example, FIG. 1 illustrates individually customized shoulder rest 10 that may be operable for use with a stringed instrument such as mounted to the underside of the body of a violin 30.

Figure 2:
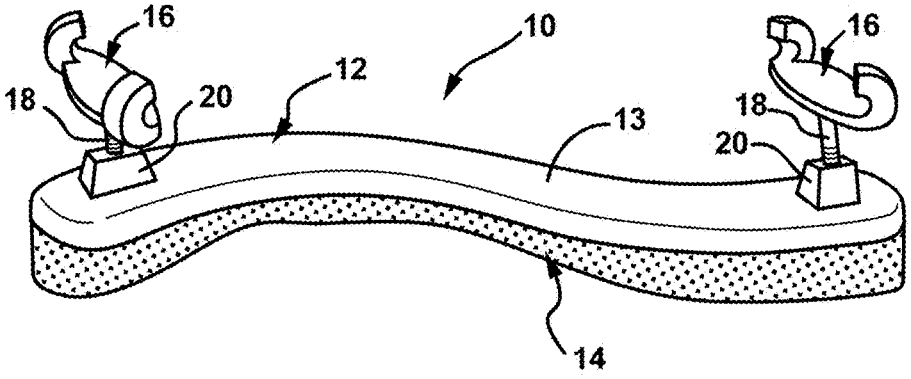
FIG. 2 is an enlarged perspective view of the individually customized musical instrument support of FIG. 1.

As shown in FIG. 2, individually customized musical instrument support 10 may generally include a universal component 12 and an individually customized element 14. Universal component 12 may have a standardized configuration and be attachable to various sized single-type instruments for use by multiple instrument players. For example, universal component 12 may include a rigid structural portion or principal member 13, in this example extending laterally across the body of the instrument, releasably attaching means such as clamping members 16 operable for attaching the support to various sized single-type musical instruments, and base members 20 operable for mounting the clamping members 16 to structural member 13.

Figure 3:
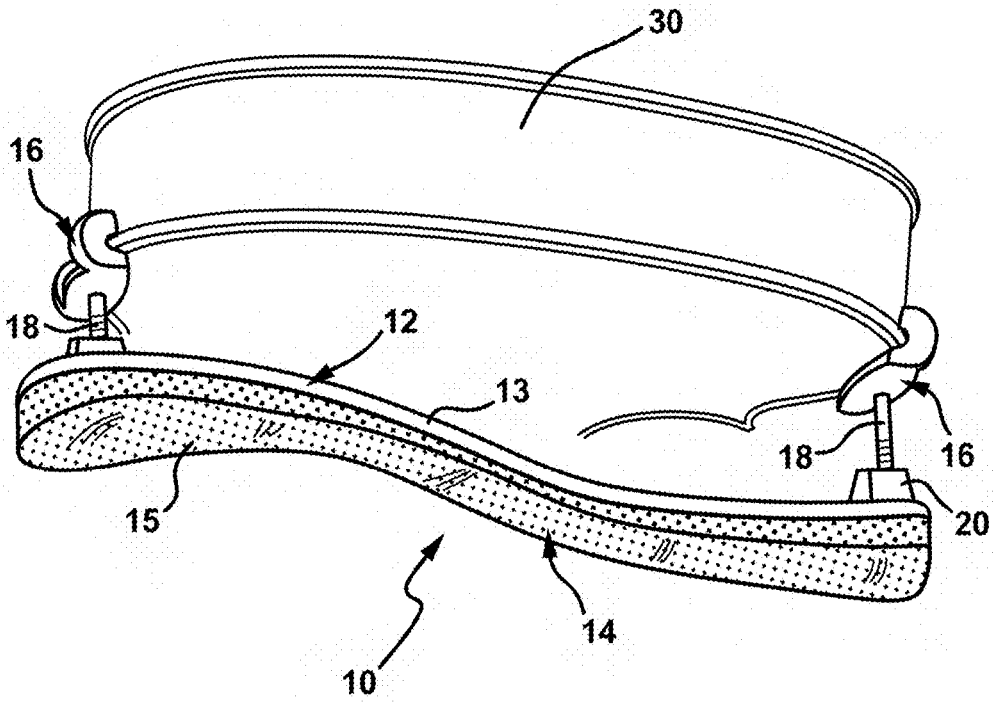
FIG. 3 is another enlarged perspective view of the individually customized musical instrument support of FIG. 1 attached to the violin.

Individually customized element 14 may include a first portion having an individually customized resilient contoured surface contoured to substantially fit to the instrument player's contoured body surface which is in proximity to placement of the customized instrument support on the instrument player during playing of the musical instrument, e.g., corresponding to an impression of the portion of the instrument player's body on which said individually customized musical instrument support is disposed during playing of the musical instrument. For example, individually customized element 14 may rest on the shoulder and chest area of the instrument player (as shown in FIG. 1). Advantageously, as shown in FIG. 3, individually customized element 14 may provide a surface 15, which is shaped to substantially fit or correspond to the actual contours and surfaces of an individual player during use of the shoulder rest, thereby improving the comfort of the player and the player's control of the instrument.

Figure 4:
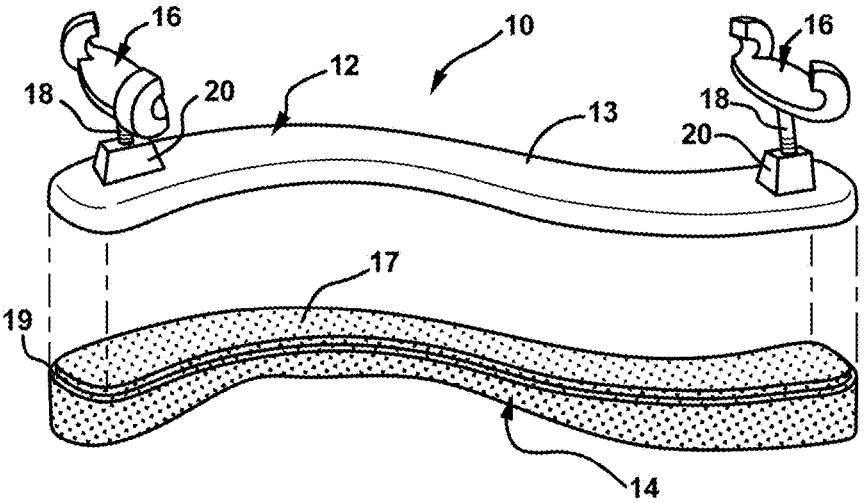
FIG. 4 is an exploded perspective view of the individually customized musical instrument support of FIG. 1.
Figure 5:
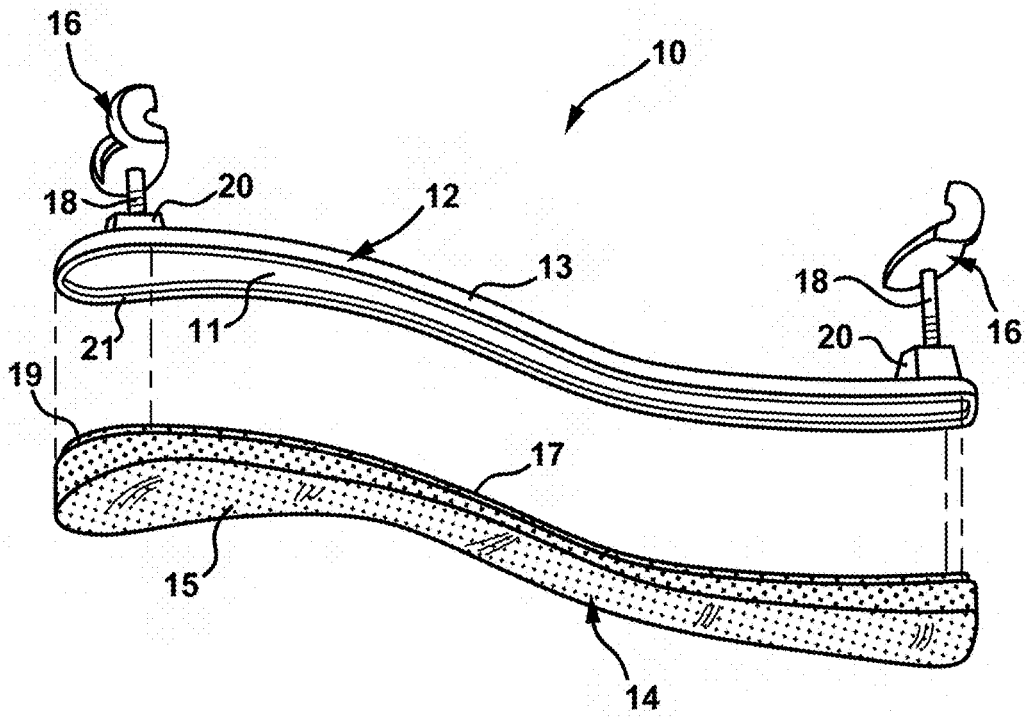
FIG. 5 is another exploded perspective view of the individually customized musical instrument support of FIG. 1.

As shown in FIGS. 4 and 5, individually customized element 14 may mate and attach to universal component 12. For example, a second portion of individually customized element 14 may have a surface 17 having a recessed peripheral edge 19 so that surface 17 mates with a surface 11 of universal component 12 having a raised peripheral edge 21 (FIG. 5). While individually customized element 14 is configured for the individual for optimal use by the individual player, universal component 12 may have a standardized configuration that may be used for instrument supports for multiple players.

With reference again to FIGS. 2 and 3, universal component 12 may include means or members known in the art for adjusting the position of the instrument support with respect to the instrument, such as, for example, screw members 18 connectable between clamping members 16 and base members 20, which allow for adjustment of the offset distance of each end of shoulder rest 10 relative to the bottom of the violin. As another example, the distance between clamping members 16 may also be adjusted by providing means for adjusting the position of base members 20 longitudinally along structural member 13. Clamping members 16 may allow for attachment of shoulder rest 10 along a range of positions on the violin body.

With reference again to FIGS. 4 and 5, the mating of individually customized element 14 to universal component 12 may include surface 17 of individually customized element 14 fitting and being secured to opposing surface 11 (FIG. 5) of universal component 12. Universal component 12 and individually customized element 14 may be permanently attached to each other, using, for example, an adhesive material. Desirably, universal component 12 and individually customized element 14 may be configured to be reversibly or releasably attachable and separable to and from each other, such that the elements may be repeatedly returned to the same attached position, using, for example, hook and loop fasteners, clips, screws, or other suitable fastening devices.

It will be appreciated that the area defined by the broad surfaces of individually customized element 14, e.g., surface 17, need not be the same as the area defined by the broad surfaces of universal component 12, e.g., surface 11 (FIG. 5). It may be advantageous, for example, for surface 17 to extend beyond the boundaries of the opposing surface of universal component 12, as long as component 12 and individually customized element 14 are mated in a position that maintains the desired fit of individually customized element 14 to the body of the instrument player. Additionally, the projected area of surface 15 (FIG. 3) and surface 17 (FIG. 4) of individually customized element 14 need not be the same, and the individually customized surface 15 may be divided into sections which contact the player's body, separated by sections which are not in contact with the player's body.

Universal component 12 and individually customized element 14 may be desirably made of different materials. Universal component 12, and specifically structural member 13, may be desirably made of a relatively stiff material which provides structural strength but still possesses some flexibility to facilitate attachment of the support to the instrument, examples of such materials being a rigid plastic or polymeric material such as thermoplastic resins or wood. Individually customized element 14 may be desirably made of material or materials which are readily fabricated or rendered into the desired individual customized shape through forming, casting, milling or other means, and as described below based on an impression of the instruments player's body, and having when not placed on the instrument player enough rigidity to substantially retain the desired individual customized shape, and optionally some degree of flexibility and pliability for comfort when in use. An example of a desirable material for individually customized element 14 is a foam material such as a thermoplastic foam of a Shore A hardness of about 40 or greater.

Figure 6:
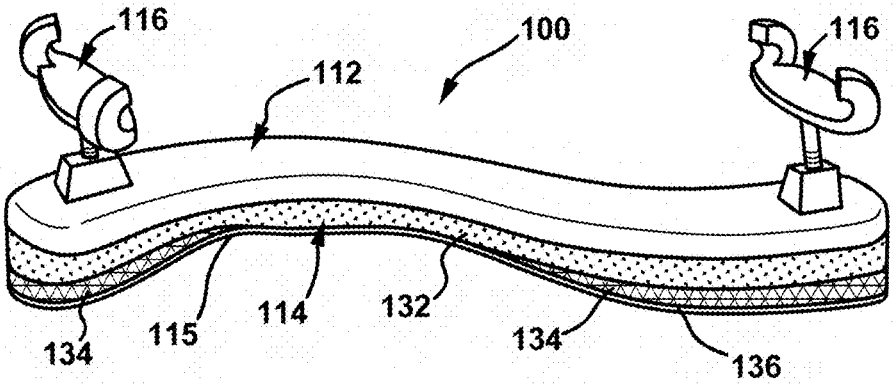
FIG. 6 is a perspective view of another individually customized musical instrument support according to an embodiment of the present disclosure, illustrating a violin shoulder rest.

FIG. 6 illustrates another individually customized musical instrument support 100 according to an embodiment of the present disclosure in which an individually customized element 114 generally includes a plurality of layers or parts. Optionally the layers or parts may be composed of the same or a plurality of different materials. In this example, individually customized element 114 may include three layers, each of a different material with different material properties. For example, a layer 132 may be a thermoplastic foam of relatively high durometer hardness operable to provide stiffness, a layer 134 may be a thermoplastic foam of a lower durometer hardness operable to provide improved comfort in the course of normal playing motions, and a layer 136 may be a fabric operable to provide a desirable surface texture, durability, or appearance. A fewer or greater number of layers, selecting from materials of different physical properties, also may be used. For example, a layer made of a rigid thermoplastic resin may be added on the surface of individually customized element 114 opposing universal component 112, to facilitate the incorporation of fastening devices to reversibly or releasably attach universal component 112 to individually customized element 114. As shown in FIG. 6, the individual layers or parts need not cover the same surface area, nor do they need to be of the same or consistent thickness.

With reference again to FIGS. 2-6, universal component 12 (FIGS. 2-5) and universal component 112 (FIG. 6) may be produced by molding, forming, machining or other conventional means. Desirably, individually customized element 14 (FIGS. 2-5) and individually customized element 114 (FIG. 6), and specifically individually shaped surface 15 (FIG. 3) and 115 (FIG. 6) may be substantially produced by a computer-aided fabrication method, which may advantageously transform a model or design of the desired shape into a finished part rapidly, with less effort, and with greater accuracy than manual methods. Desirably, individually customized elements 14 (FIGS. 2-5) and 114 (FIG. 6) may be substantially produced using the apparatus and method based on an impression of the instruments player's body as described in greater detail below.

Figure 7:
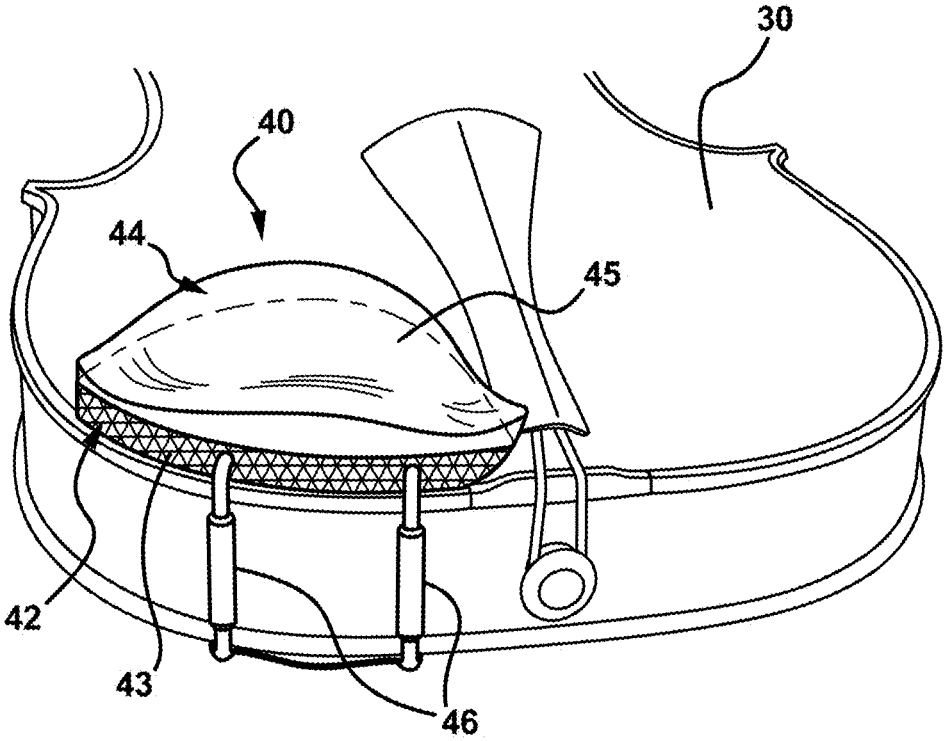
FIG. 7 is a perspective view of another individually customized musical instrument support according to an embodiment of the present disclosure, illustrating a violin chin rest.

FIG. 7 illustrates another individually customized musical instrument support according to an embodiment of the present disclosure, in the form of a violin chin rest 40 which generally includes a universal component 42 and an individually customized element 44. Universal component 42 may include members conventionally provided in chin rests, namely, a rigid structural portion comprising a principle member 43, in this example extending from the top rim of the violin 30 across a portion of the top tail section of the violin, and clamping member 46 for attaching the support to the instrument.

In use, a portion of the instrument player's jaw and chin rests on individually customized element 44. Advantageously, individually customized element 44 provides a surface 45 which is shaped to substantially fit the contours and surfaces of the jaw and chin area of the individual player using the chin rest, thereby improving the comfort of the player and the player's control of the instrument. Individually customized element 44 may mate with and attach to universal component 42. While individually customized element 44 is configured for optimal use by an individual player, universal component 42 has a standardized configuration that may be used for instrument supports for multiple players.

Clamping member 46 allows for attachment of chin rest 40 in a range of positions along the violin body. Universal component 42 may include other members providing further adjustments of the chin rest relative to the violin, such as the adjustment of the height of principle structure member 43 above the body of the violin.

Universal component 42 and individually customized element 44 may be permanently attached to each other, using, for example, an adhesive material. Desirably, universal component 42 and individually customized element 44 are configured to be reversibly or releasably attachable to each other in a repeatable position while being separable. It will be appreciated that other alternatives of design discussed above with respect to the example of a shoulder rest may be applied to the design of the example of the chin rest, and to other musical instrument supports generally.

Figure 8:
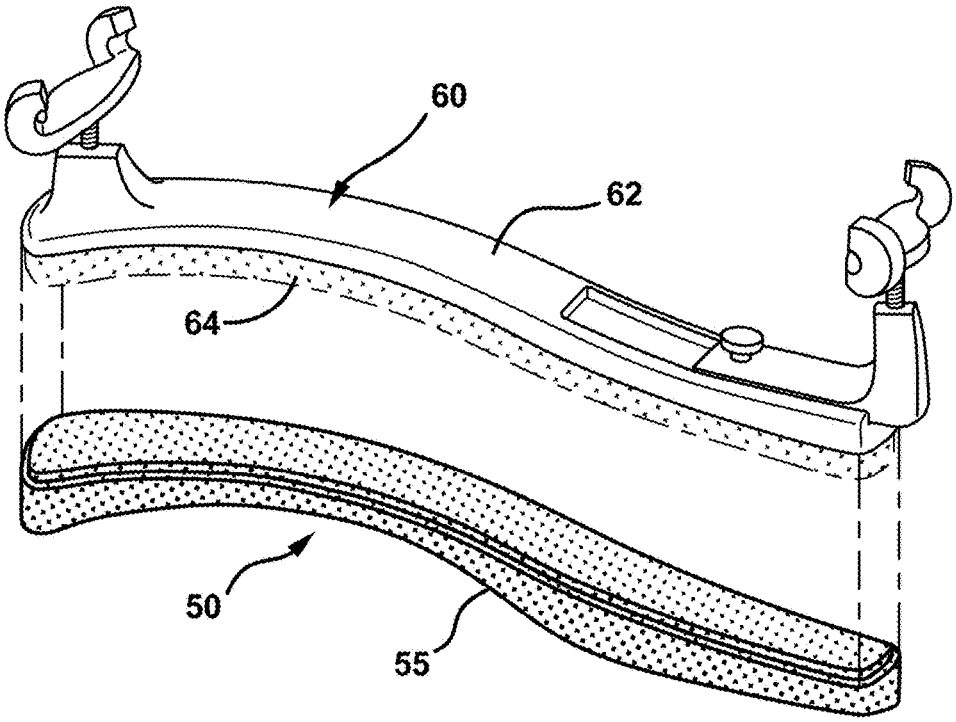
FIG. 8 is an exploded perspective view of an individually customized element attachable to a portion of a universal component of a musical instrument support according to an embodiment of the present disclosure, illustrating an attachment to a violin shoulder rest.
Figure 9:
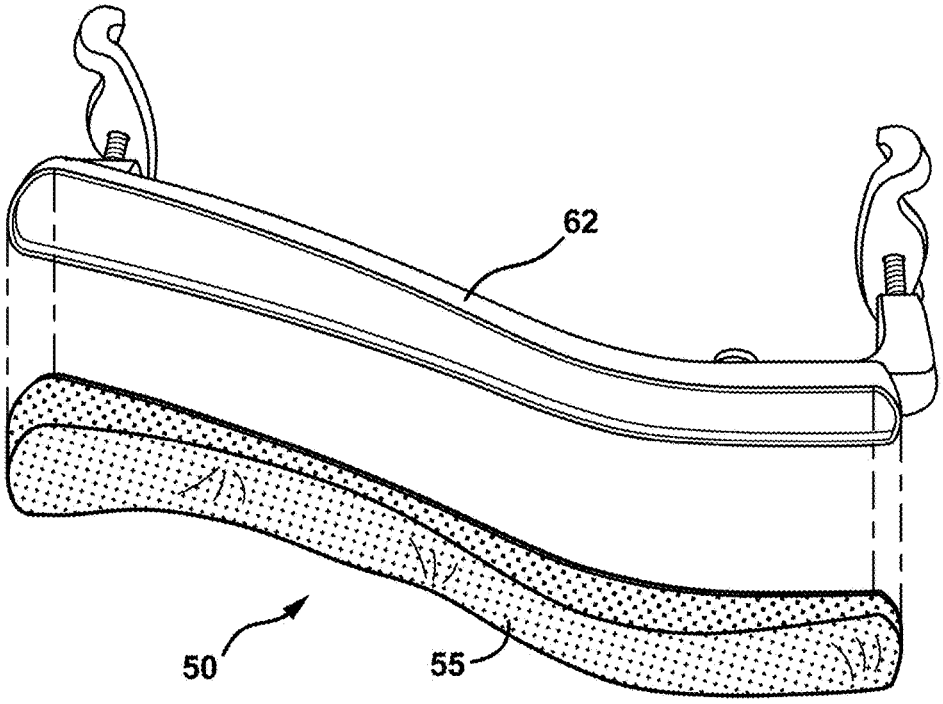
FIG. 9 is another exploded perspective view of the individually customized element of FIG. 8 attached to the portion of the universal component of the musical instrument support.

FIGS. 8 and 9 illustrate an individually customized element 50 for use with a portion of an existing musical instrument support 60 (FIG. 8), e.g., the lower standard contoured padding portion 64 (FIG. 8), shown in dashed lines, being removed from a universal component 62, according to an embodiment of the present disclosure. For example, individually customized element 50 provides a customized surface 55 which is shaped to substantially fit or correspond to the contours of a part of an individual instrument player's body. In this instance, the embodiment is illustrated by individually customized element 50 being attachable to universal component 62 of existing shoulder rest 60 (FIG. 8). Universal component 62 of existing shoulder rest 60 (FIG. 8) provides the principle structural portion for the assembly of the standard instrument support and individually customized element. Universal component 62 of existing shoulder rest 60 (FIG. 8) may be used in its entirety or portions may be removed to allow for the addition of individually customized element 50, which advantageously modifies the existing shoulder rest to fit an individual player.

Individually customized element 50 may be permanently attached to universal component 62 of existing shoulder rest 60 (FIG. 8), using, for example, an adhesive material. Desirably, individually customized element 50 includes members so that it may be reversibly or releasably attachable to universal component 62 of existing shoulder rest 60 (FIG. 8) in a repeatable position and separable. Individually customized element 50 is desirably made of a material or materials which are readily rendered into the desired individual shape through forming, casting, milling or other means and as described below based on an impression of the instruments player's body, and when in use in contact with the player possesses enough rigidity to substantially retain the desired individual shape, and optionally some degree of flexibility and pliability for comfort when in use. An example of a desirable material for individually customized element 50 may be a foam material such as a thermoplastic foam of a Shore A hardness of about 40 or greater. The area defined by the broad surfaces of individually customized element 50 need not be the same as the area defined by the broad surfaces of existing shoulder rest 60. Individually customized element 50 may include a plurality of layers, in which the layers may be composed of the same or a plurality of different materials. It will be appreciated that other alternatives of design as discussed above with respect to the examples of individually customized elements of a musical instrument support are applicable to the design of individually customized element 50 to an existing shoulder rest 60, and to individually customized elements to other musical instrument supports generally.

Desirably, individually customized element 50, and specifically individually shaped surface 55 thereof which corresponds to an impression of the contours of an individual player's body, is substantially produced by a computer-aided fabrication method, and desirably using the apparatus and method as described in greater detail below.

Figure 10:
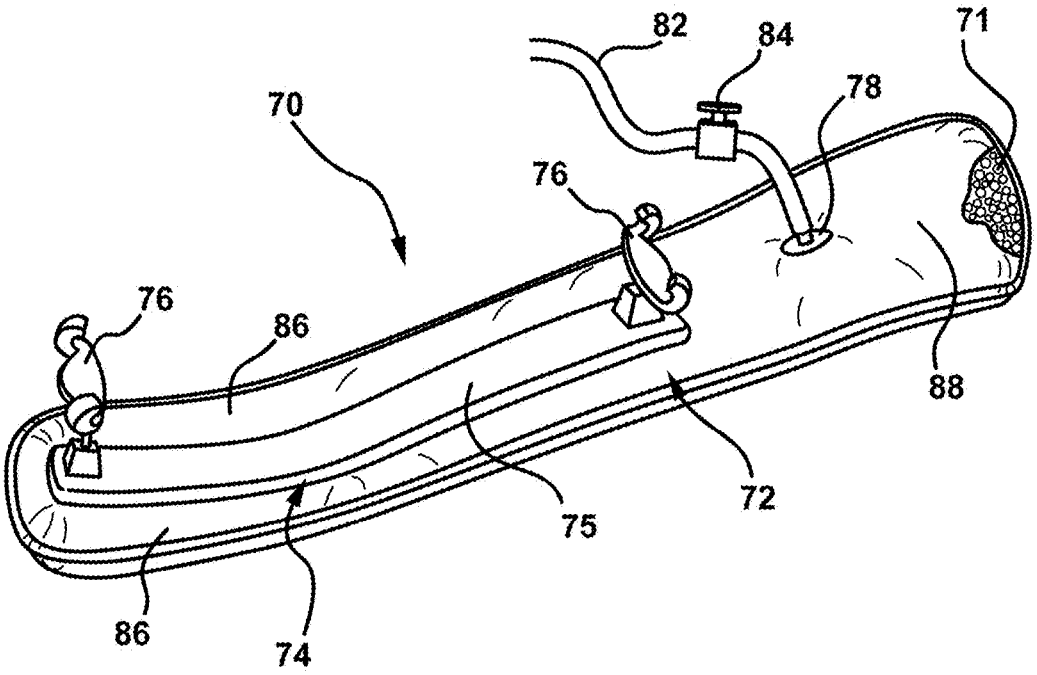
FIG. 10 is a perspective view, portions cutaway, of an apparatus according to an embodiment of the present disclosure for use in forming an individually customized element for use in an individually customized musical instrument support.

FIG. 10 illustrates an apparatus 70 according to an embodiment of the present disclosure for making a customized mold or impression of the contours of a portion of a musical instrument player's body for use in forming an individually customized musical instrument support. Apparatus 70 generally includes a shape-conforming bag 72 of controllable rigidity for use with a platform component 74. The platform component may correspond to or be a principal structural member of, for example, a shoulder rest. For example, platform component 74 may be a template of a universal component, a universal component for forming the customized musical instrument support, or a portion of an existing musical instrument support for use in forming the customized musical instrument support.

Apparatus 70 is useful for making a mold or impression of the part of a musical instrument player's body in proximity to a musical instrument support, thereby advantageously aiding the production of instrument supports shaped or tailored to fit to individual instrument players. Apparatus 70 of FIG. 10 illustrates a particular example of an apparatus for making molds or impressions for the shoulder area of an instrument player, useful in the production of individually shaped shoulder rests for stringed instruments.

Bag 72 may include a top wall or area, a bottom wall or area (not shown in FIG. 10) opposite top wall or area, and be joined along the peripheral edges. Bag 72 may be fabricated in alternative configurations that define an enclosed space, such as a seamless bladder or a tube sealed on both ends. The walls of bag 72 may be made of a thin, impermeable, flexible, and elastically extensible material. Suitable materials include rubber, certain plastics, and laminated sheet materials. Bag 72 may contain a free-flowing granular material 71 and fluid. Suitable free-flowing granular materials include a variety of mineral-based particulate materials or synthetic beads. Desirably, the free-flowing granular material is thermoplastic beads and the fluid is air. For use in connection with an individually customized violin shoulder rest the bag may be about 16 inches long, and about 4 inches wide.

Bag 72 may be provided with a port 78, impermeably sealed to the bag and provided with a screen or other means to contain the granular material within the bag while allowing flow of fluid into and out of the bag. Port 78 is connected to tubing 82 to direct fluid flow, and a valve 84 is provided, either in the fluid pathway of tubing 82 or integral with port 78, to control fluid flow through the port. Bag 72 may also be provided with a second port (not shown), which is sealed closed when port 78 is in use for the control of fluid in the bag but otherwise may be opened to add granular material to or remove granular material from the bag.

Advantageously, the bag 72 as described may be changed between a deformable state, in which it conforms to shapes in contact with it, and a rigid state, in which it retains its shape, by controlling the amount of fluid in the bag. The bag is in the deformable state when it contains sufficient fluid for the granular material to move or flow within the bag. When the fluid is air, this state is achieved when the air pressure within the bag is essentially the same as or greater than the air pressure external to the bag. When fluid is withdrawn, the bag changes to a rigid state and retains the shape it was in when the fluid was withdrawn. When the fluid is air the rigid state is achieved when the bag is evacuated. Within a range of partial removal of fluid, the bag achieves an intermediate moldable state, in which it does not deform freely around external shapes, but can be molded to external shapes by applying moderate pressure against the bag walls. The changes between states are reversible, which gives apparatus 70 the desirable quality of being reusable.

The platform component 74 may include clamping members 76 for attaching the apparatus to the stringed instrument and a rigid member 75 covering at least the same area as that part of a shoulder rest that contacts an instrument player's body. The bag 72 contacts member 75 of the platform component 74 and bag 72 has a surface area that covers at least the surface of the member 75. Bag 72 may be temporarily or permanently attached to member 75, or simply in contact when in use.

Figure 11:
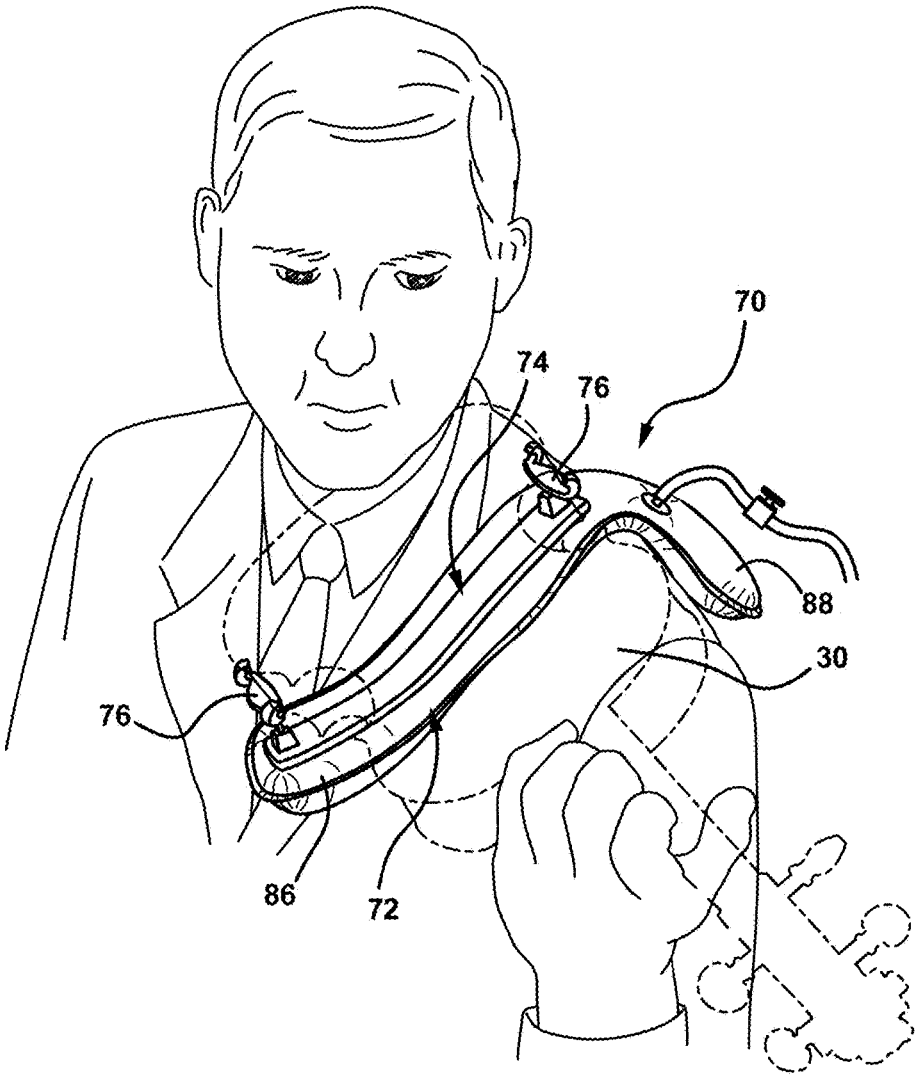
FIG. 11 is a perspective view of the apparatus of FIG. 10 disposed on a player's body for supporting an instrument and for use in forming an individually customized element of an individually customized musical instrument support.

FIG. 11 illustrates apparatus 70 in a position for acquiring a mold or impression for an individually shaped shoulder rest. Apparatus 70 is positioned between a violin 30 (shown in dashed lines in FIG. 11) and the player. Platform component 74 is attached to violin 30 by clamping members 76. More specifically, bag 72 of the apparatus is positioned between rigid member 75 of platform component 74 and the shoulder and chest area of the player, in order to capture an impression of that part of the player's body beneath and opposed to member 75. Desirably, bag 72 may include additional areas not in contact with member 75, such as areas 86 to the side of member 75 or area 88 distant from member 75, these areas providing space within the bag for granular material to flow to when not needed to create a mold or impression of the area beneath member 75.

Referring again to FIGS. 10 and 11, it will be appreciated that the platform component 74, and in particular rigid member 75, provides a rigid backing surface to support the shape-conforming bag during the creation of the mold or impression, and platform component 74 and rigid member 75 may be any configuration that performs this function, so long as rigid member 75 covers at least the same area as that part of a shoulder rest that contacts an instrument player's body.

With reference to FIGS. 4, 5, and 11, in order to facilitate the fabrication of a customized shoulder rest as described above, it is desirable for platform component 74 (FIG. 11) to correspond to or be the same or essentially the same as the universal component 12 (FIGS. 4 and 5) of the shoulder rest, whereby the apparatus will more directly yield molds or impressions for surfaces 15 and 17 (FIGS. 4 and 5) of the individually customized element 14 (FIGS. 4 and 5). With reference to FIGS. 8 and 9, in order to facilitate the fabrication of an individually customized element 50 to an existing standard shoulder rest 60 (FIG. 8) it is desirable for the platform component 74 (FIG. 11) to correspond to or be the standard shoulder rest 60 (FIG. 8) or that part of a standard shoulder rest (FIG. 9) to be used in conjunction with individually customized element 50, whereby the apparatus will more directly yield molds or impressions for the surfaces of the individually customized element 50. It will be appreciated that the present description of an apparatus for shoulder rests are useful for apparatuses for instrument supports in general.

Advantageously, apparatus 70, in contrast to various casting methods, produces molded surfaces or impressions rapidly and without any wet or resinous casting substances contacting or near the individual or instrument. Additionally, the apparatus may be reused repeatedly with multiple individuals without modification.

Figure 12:
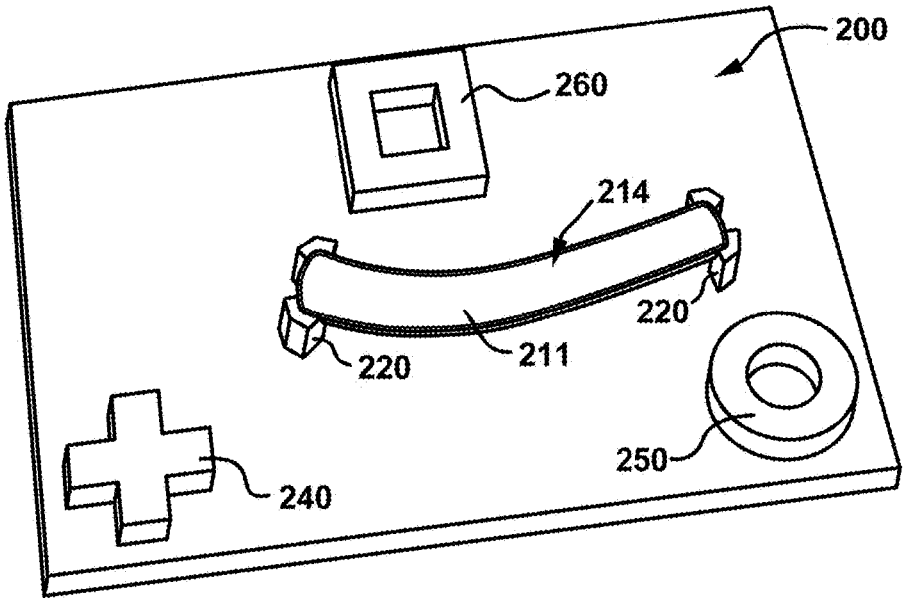
FIGS. 12 and 13 are perspective views of a holding and scanning fixture for use in a process for producing an individually customized musical instrument support according to an embodiment of the present disclosure.
Figure 13:
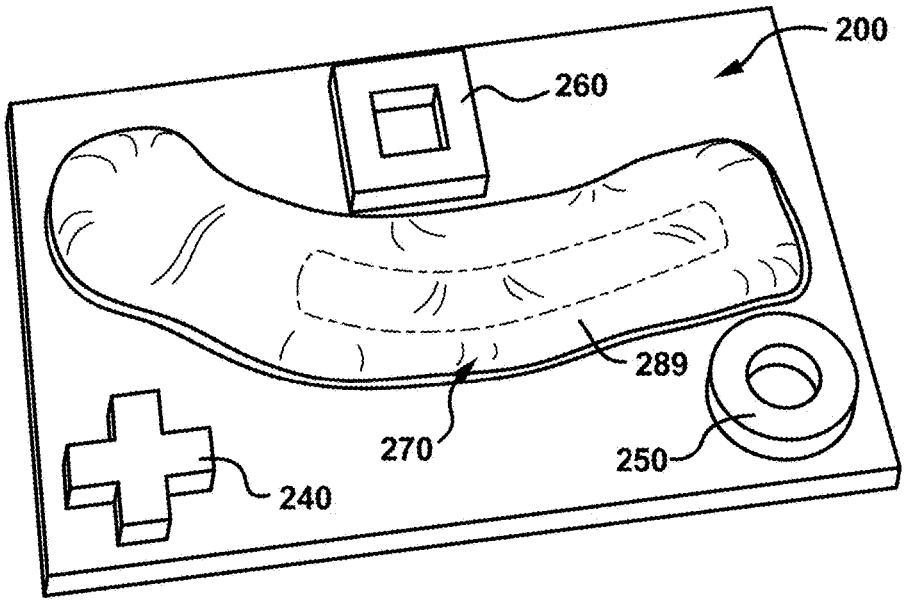

FIGS. 12 and 13 are diagrammatic illustrations of a holding and scanning fixture 200 for use in a process for use in producing a musical instrument support according to an embodiment of the present disclosure. Fixture 200 is operable for aligning a platform component 214 (FIG. 12) and shape-conforming bag 270 (FIG. 13) during surface scanning. With reference to FIG. 12, fixture 200 may include support members 220 operable for holding platform component 214 in a fixed position on fixture 200, and alignment shapes 240, 250, and 260 operable for unique 3-dimensional alignment of scans of objects held in the fixture. It will be appreciated that alignment may be accomplished using tooling holes, pins, or other alignment means. Platform component 214, separate from other elements of the apparatus, may be held in a fixed position by support members 220. Surface 211, which is the surface of platform component 214 that faces away from the instrument and is in contact with the shape-conforming bag when the apparatus is in position for acquiring a mold or impression, faces outwardly for scanning.

With reference to FIG. 13, a shape-conforming bag 270 of an apparatus is disposed in position for scanning after acquiring a mold or impression. Shape-conforming bag 72 is attached or positioned in the same relative position to platform component 214 as during acquiring of the mold or impression, and platform component 214 (the position of which underneath the bag being indicated by dashed lines in FIG. 13) is held in the same fixed position by support members 220 (FIG. 12). A surface 289 of the bag, which includes the molded impression of the player's body, faces outwardly for scanning. Separate scans of the entire fixture holding platform component 214 (FIG. 12) and holding the apparatus with bag 270 (FIG. 13) may be aligned in 3-dimensional space using alignment shapes 240, 250, and 260, yielding scans of surfaces 211 and 289 in proper 3-dimensional orientation with respect to each other. This process may be used in the construction of an electronic model of an individually customized element of a musical instrument support as described below.

Figure 14:
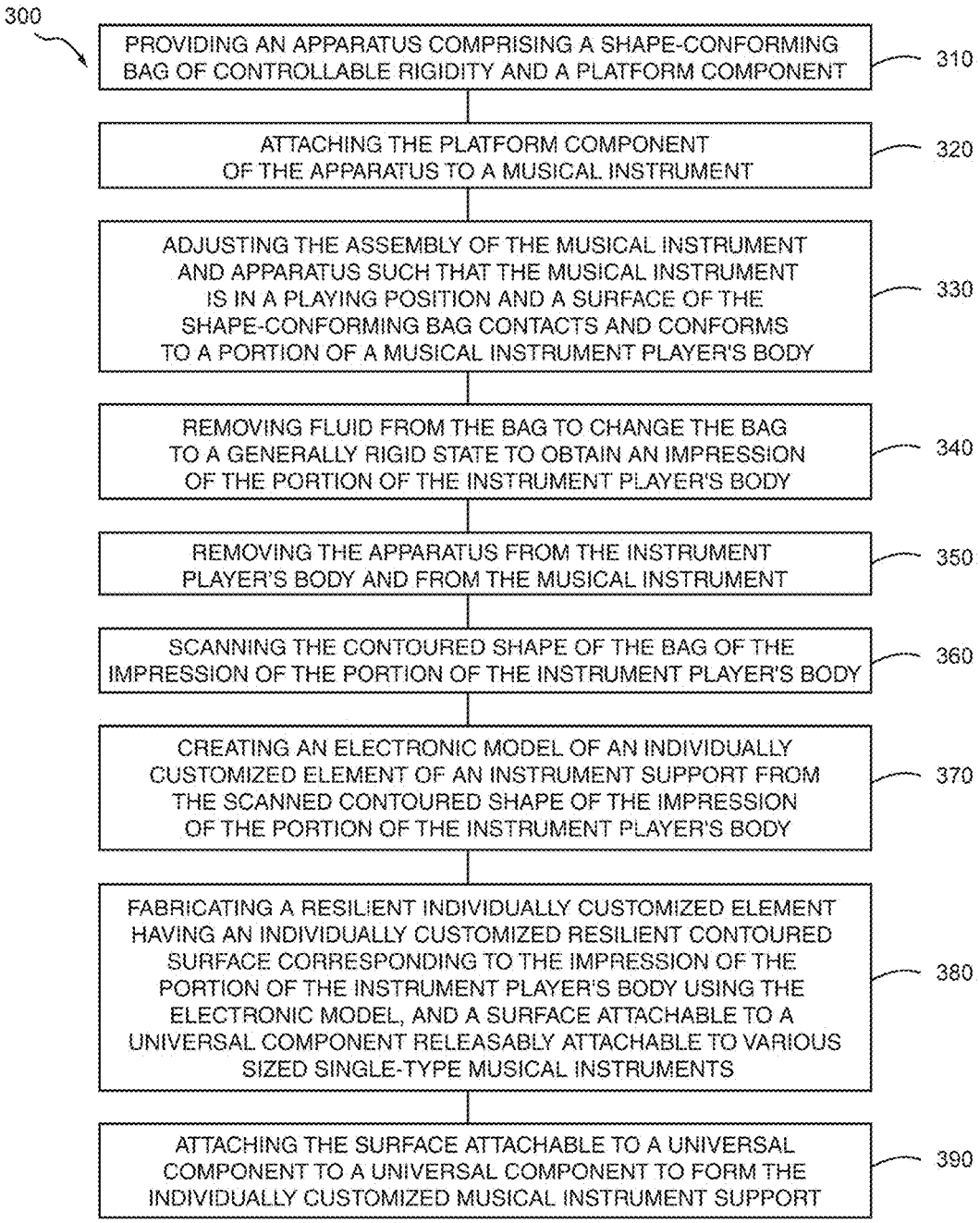
FIG. 14 is a flowchart describing a process for producing an individually customized musical instrument support according to an embodiment of the present disclosure.

FIG. 14 is a flowchart illustrating a process 300 for producing an individually customized element of a musical instrument support according to an embodiment of the present disclosure. Process 300 may utilize apparatus 70 (FIGS. 10 and 11) as described above having a shape-conforming bag of controllable rigidity and a platform component. Initially, method 300 includes at 310, providing an apparatus comprising a shape-conforming bag of controllable rigidity and a platform component. At 320, the platform component is attached to the musical instrument (for example as illustrated in FIG. 11). The apparatus may be attached to the instrument before or after positioning the apparatus on or against the player's body, depending on which is more convenient in the particular instance.

The assembly of the instrument and the apparatus are then adjusted, at 330, so that the musical instrument is in a desired playing position and a surface of the shape-conforming bag which is between the platform component and the player's body conforms to that part of the player's body which it contacts. It has been found that small movements of the apparatus while applying small amounts of pressure aid in settling the apparatus into position and establishing good contact between the shape-conforming bag and the player's body. It may be desirable, after initial adjustments with the shape-conforming bag in the fully deformable state, to withdraw a portion of the fluid from the bag to modify it to a moldable state, in which it can be further adjusted to the desired shape by applying moderate and directed pressure to the bag. In the case in which the fluid is air, it has been found that this state may be obtained by applying a slight vacuum, typically about 1 inch Hg vacuum or less, to the interior of the bag, relative to the external pressure.

When the desired position and conformation of the apparatus is achieved, fluid is removed from the shape-conforming bag to change it to a rigid state to obtain an impression of the portion of the instrument player's body at 340. Desirably the fluid is air and the rigid state is achieved by drawing a vacuum on the interior of the bag relative to the exterior, desirably about 10 inches Hg vacuum or more, and more desirably about 15 inches Hg vacuum or more. The rigid state may be maintained by continuing to pump fluid from the bag, or, if the fluid is air by continuing to apply vacuum. Desirably, the bag is provided with a valve, either integral to or connected to the fluid port and the valve is closed after the fluid is removed to maintain the rigid state of the bag without the need for further pumping or evacuation. Advantageously, if the desired position and conformation are not achieved, the shape-conforming bag may easily be returned to the deformable state by reintroducing fluid to the bag, and the apparatus may be positioned and adjusted again, as at 330, resuming the process.

The apparatus is remove from the instrument player's body and from the musical instrument at 350 and the apparatus is scanned, e.g., scanning the contoured shape of the bag of the impression of the portion of the instrument player's body at 360, for creating an electronic model of an individually customized element of an instrument support from the scanned contoured shape of the impression of the portion of the instrument player's body at 370. It may be convenient to separate the apparatus from the instrument prior to scanning by available means. The scanning may be accomplished by available methods, including surface contact probes, but desirably by non-contact optical means. At 380, a resilient individually customized element having an individually customized resilient contoured surface corresponding to the impression of the portion of the instrument player's body using the electronic model, and a surface attachable to a universal component releasably attachable to various sized single-type musical instruments is fabricated. At 390, the surface attachable to a universal component is attached to a universal component to form the individually customized musical instrument support.

Referring again to FIGS. 3, 4, 11, 12, and 13 for the example of producing an individually customized shoulder rest, and in particular for producing the individually customized element 14 (FIGS. 3 and 4), what is needed to construct the electronic model are the surface which is a molded impression of the player's body and the spatial orientation of that surface to the individually customized shoulder rest as a whole. If the platform component 74 does not correspond to or is not the same as the universal component 12, the spatial orientation of the molded impression of the player's body to the shoulder rest as a whole may be derived from the spatial orientation of the molded impression of the player's body to the platform component 74 and, in turn, the spatial orientation of platform component 74 to the shoulder rest as a whole. It will be appreciated that the electronic representation of the molded impression of the player's body, properly oriented with respect to platform component 74, may be obtained by scanning (e.g., at 360, FIG. 14), separately and in registry with each other, the platform component and the area of the shape-conforming bag which is a molded impression of the player's body. The spatial orientation of platform component 74 to the shoulder rest as a whole may be obtained by scanning (e.g., at 360, FIG. 14), separately but each in proper registry to the instrument, the platform component and the universal component 12 of the shoulder rest. Referring still to FIGS. 3, 4, 11, 12, and 13 when platform component 74 corresponds to or is the same as universal component 12, the steps of scanning surfaces and creating the electronic model (e.g., at 360 and 370, FIG. 14), are desirably simplified. It will be appreciated that in this case the surface of the bag in contact with the platform component is a negative mold of the surface of universal component 12, so that scanning (e.g., at 360, FIG. 14), separately and in registry with each other, universal component 12 and the area of the shape-conforming bag which is a molded impression of the player's body leads to properly oriented electronic representations of surfaces 17 and 15, and thus to an electronic model of individually customized element 14 in a relatively efficient manner. Referring to FIGS. 8, 9, 11, 12, and 13 for the production of an individually customized element 50 to a standard instrument support 60, it is similarly desirable for the platform component 74 to correspond to or be the standard shoulder rest 60 or that part of a standard shoulder rest to be used in conjunction with individually customized element 50.

With reference again to FIG. 14, in the construction of the digital model at 370, the scanned electronic representations may be modified by, for example, trimming the surface which is a molded impression of the player's body, adding surfaces connecting the surface which is a molded impression of the player's body and the surface contacting the platform component, or adding features to aid in attachment of the finished element to other elements of the instrument support. These and other modifications are within the spirit of this disclosure to produce a customized instrument support that substantially fits an individual player.

At 380, the individually customized element is fabricated from the electronic model by available means. The electronic model may be used, for example, to create a mold or impression for forming or casting the individually customized element using computer numerical controlled machining. Desirably, the individually customized element is fabricated as a whole or in parts from a solid block or blocks, or partially preformed block or blocks of material by computer numerical machining. Alternatively, the individually customized element may be fabricated by stereolithography.

With reference to the musical instrument supports discussed above which generally includes a universal component and an individually customized element, the universal component is fabricated using available methods and the individually customized element is fabricated using, for example, process 300. It will be appreciated that features of this description of process 300 with respect to shoulder rests are useful for instrument supports with individually customized elements in general and for individually customized elements to instrument supports in general.

Advantageously, process 300 and the variations described above, in contrast to various casting methods, produces molded surfaces rapidly and without any wet or resinous casting substances contacting or near the individual or instrument. Process 300 provides a practical method for producing customized musical instrument supports.

Figure 15:
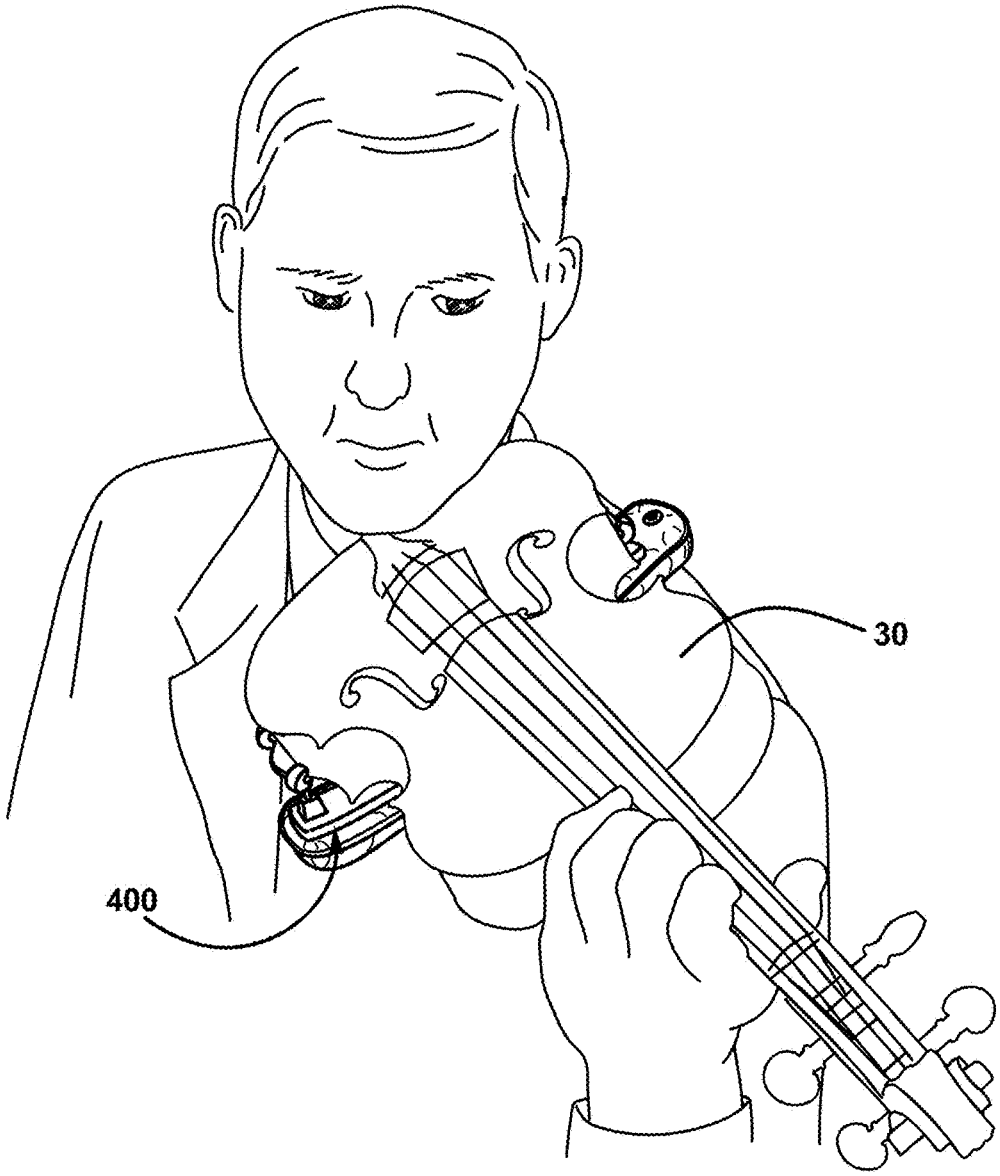
FIG. 15 is a perspective view of a customizable musical instrument support according to an embodiment of the present disclosure, illustrating a violin shoulder rest.

FIG. 15 illustrates a customizable musical instrument support 400 according to an embodiment of the present disclosure, for use in supporting a musical instrument 30 on or against a portion of an instrument player's body. For example, FIG. 15 illustrates a customizable shoulder rest 400 that may be operable for use with a stringed instrument such as mounted to the underside of the body of a violin 30.

Figure 16:
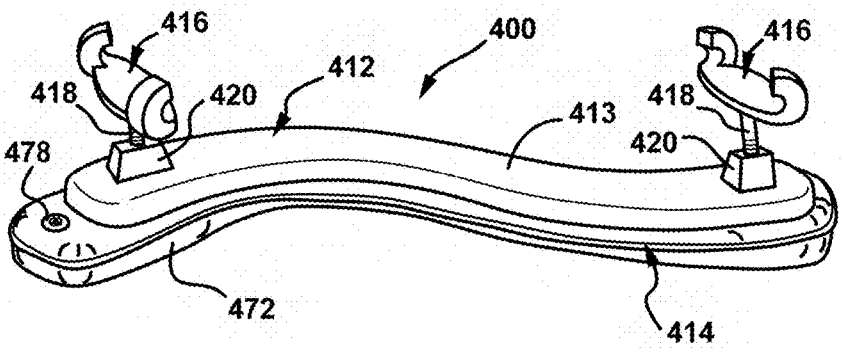
FIG. 16 is an enlarged perspective view of the customizable musical instrument support of FIG. 15.
Figure 17:
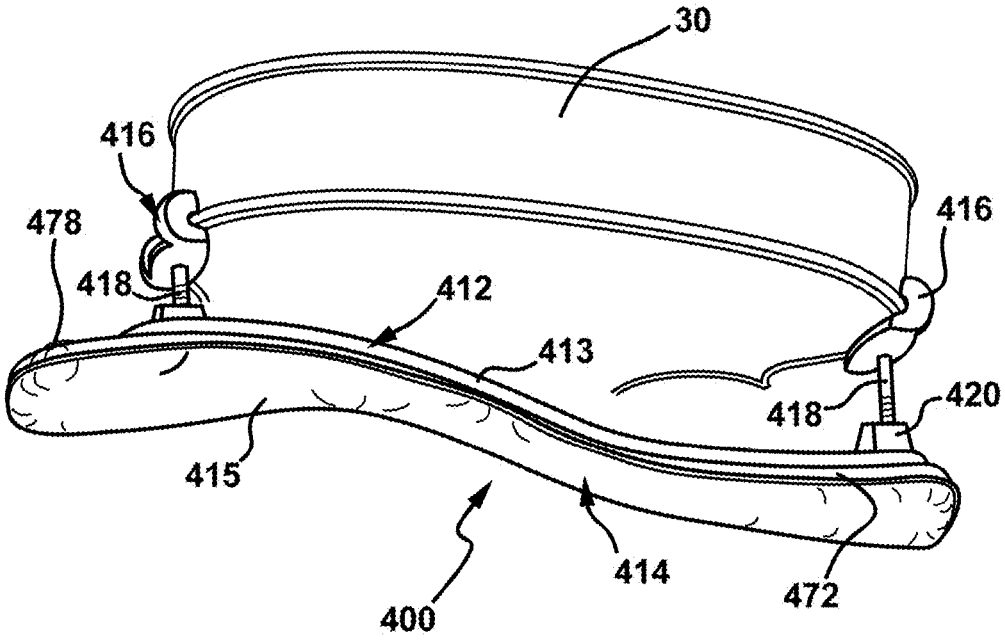
FIG. 17 is another enlarged perspective view of the customizable musical instrument support of FIG. 15 attached to the violin.

As shown in FIGS. 16 and 17, customizable musical instrument support 400 may generally include a universal component 412 and an individually customizable element 414. Universal component 412 may have a standardized configuration and be attachable to various sized single-type instruments for use by multiple instrument players. For example, universal component 412 may include a principal structural member 413, in this example extending laterally across the body of the instrument, clamping members 416 operable for attaching the support to the instrument, and base members 420 operable for mounting the clamping members 416 to structural member 413.

Individually customizable element 414 may include a customizable surface shapeable to substantially fit to the instrument player's contoured body surface which is in proximity to placement of the customizable instrument support on the instrument player during playing of the musical instrument. As described in greater detail below, individually customizable element 414 may be a formable customizable element, initially being in a moldable state and being changeable into a generally rigid state.

Figure 18:
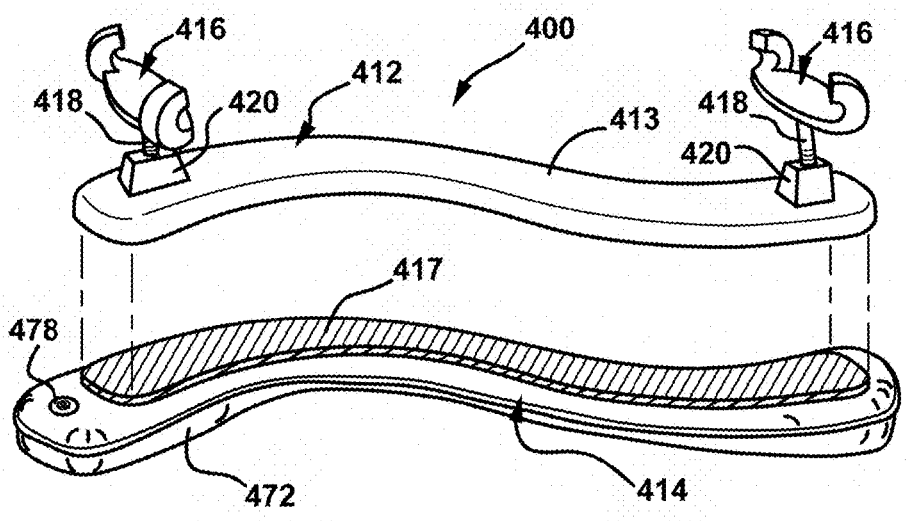
FIG. 18 is an exploded perspective view of the customizable musical instrument support of FIG. 15.
Figure 19:
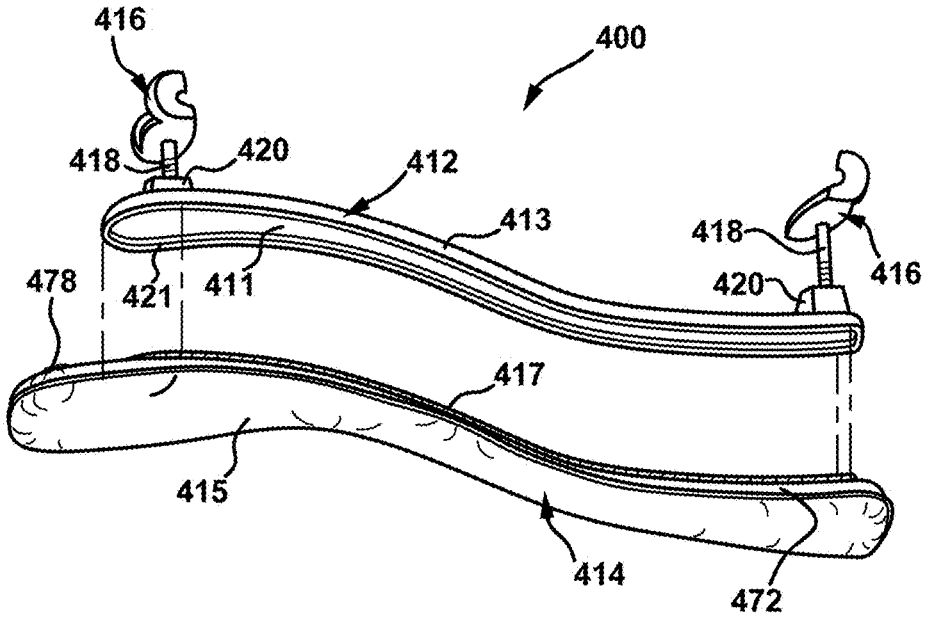
FIG. 19 is another exploded perspective view of the customizable musical instrument support of FIG. 15.

For example, individually customizable element 414 may rest on the shoulder and chest area of the instrument player (as shown in FIG. 15). Advantageously, as shown in FIG. 17, individually customizable element 414 may provide a surface 415, which is shapeable to substantially fit or correspond to the actual contours and surfaces of an individual player during use of the shoulder rest, thereby improving the comfort of the player and the player's control of the instrument. As shown in FIGS. 18 and 19, individually customizable element 414 may mate and attach to universal component 412. For example, individually customizable element 414 may include plate member 417 (FIGS. 18 and 19) which may mate with a surface 411 (FIG. 19) bounded by raised peripheral edge 421 (FIG. 19) of universal component 412. While individually customizable element 414 may be formed for the individual for optimal use by the individual player, universal component 412 may have a standardized configuration that may be used for instrument supports for multiple players.

With reference again to FIGS. 16 and 17, universal component 412 may include members known in the art for adjusting the position of the instrument support with respect to the instrument, such as, for example, screw members 418 connectable between clamping members 416 and base members 420, which allow for adjustment of the offset distance of each end of shoulder rest 400 relative to the bottom of the violin. As another example, the distance between clamping members 416 may also be adjusted by providing means for adjusting the position of base members 420 longitudinally along structural member 413. Clamping members 416 may allow for attachment of shoulder rest 400 along a range of positions on the violin body.

With reference again to FIGS. 18 and 19, the mating of individually customizable element 414 to universal component 412 may include plate member 417 of individually customizable element 414 fitting and being secured to opposing surface 411 (FIG. 19) of universal component 412. Universal component 412 and individually customizable element 414 may be permanently attached to each other, using, for example, an adhesive material. Desirably, universal component 412 and individually customizable element 414 may be configured to be reversibly or releasably attachable and separable to and from each other, such that the elements may be repeatedly returned to the same attached position, using, for example, hook and loop fasteners, clips, screws, or other suitable fastening devices.

It will be appreciated that the projected area of surface 415 (FIG. 19) of individually customizable element 414, need not be the same as the projected area of the broad surfaces of universal component 412, e.g., surface 411 (FIG. 19). It may be advantageous, for example, for surface 415 to extend beyond the projected boundaries of the surface 411 (FIG. 19) of universal component 412, as long as component 412 and individually customizable element 414 are mated in a position that maintains the desired fit of individually customizable element 414 to the body of the instrument player. Individually customizable surface 415 (FIG. 19) may be divided into sections which contact the player's body, separated by sections which are not in contact with the player's body.

Universal component 412, and specifically structural member 413, may be desirably made of a relatively stiff material which provides structural strength and provides a rigid backing surface for individually customizable element 414 but still possesses some flexibility to facilitate attachment of the support to the instrument, examples of such materials being thermoplastic resins or wood. Structural member 413 desirably covers at least the area of that surface of the instrument player's body to which a customized contoured surface is to be formed. Individually customizable element 414 may desirably be an assembly, initially in a generally moldable state, which may allow it to be readily formed into a desired individual customized shape, and while in the individually customized shape may be readily changed to a generally rigid state, which, when in use in contact with the player, possesses enough rigidity to substantially retain the desired individual customized shape.

Individually customizable element 414 may include a shape-conforming bag of controllable rigidity. As illustrated in FIGS. 16 through 20, shape-conforming bag 472 of individually customizable element 414 may include a top wall or area, a bottom wall or area opposite top wall or area, and be joined along the peripheral edges. The shape-conforming bag may be fabricated in alternative configurations that define an enclosed space, such as a seamless bladder or a tube sealed on both ends. The walls of shape-conforming bag 472 of individually customizable element 414 may be made of a thin, impermeable, and flexible material. Suitable materials include rubber, certain plastics, and laminated sheet materials. Individually customizable element 414 may contain a free-flowing granular material and fluid. Suitable free-flowing granular materials include a variety of mineral-based particulate materials or synthetic beads. Desirably, the free-flowing granular material is thermoplastic beads and the fluid is air. For use in connection with an individually customizable violin shoulder rest the bag may be at least the size of a typical shoulder rest, which is about 8 inches long, and about 1.5 inches wide.

Individually customizable element 414 may be provided with a port 478 (FIGS. 16-20), impermeably sealed to the bag and provided with a screen or other means to contain the granular material within the bag while allowing flow of fluid into and out of the bag. Port 478 is provided with means to close or seal it, desirably in a reversible manner, such as an integral valve, check valve, self-sealing needle port or other suitable device. Individually customizable element 414 may also be provided with a second port (not shown), which is sealed closed when port 478 is in use for the control of fluid in the bag but otherwise may be opened to add granular material to or remove granular material from the individually customizable element 414.

Advantageously, individually customizable element 414 as described may be changed between a deformable state, in which it conforms to shapes in contact with it, and a rigid state, in which it retains its shape, by controlling the amount of fluid in the individually customizable element. The individually customizable element is in the deformable state when it contains sufficient fluid for the granular material to move or flow within the individually customizable element. When the fluid is air, this state is achieved when the air pressure within the bag is essentially the same as or greater than the air pressure external to the bag. When fluid is withdrawn, the bag changes to a rigid state and retains the shape it was in when the fluid was withdrawn. When the fluid is air the rigid state is achieved when the individually customizable element is evacuated. Within a range of partial removal of fluid, the bag achieves an intermediate moldable state, in which it does not deform freely around external shapes, but can be molded to external shapes by applying moderate pressure against the bag walls. The changes between states are reversible, which gives the individually customizable element the desirable quality of being reusable.

Figure 20:
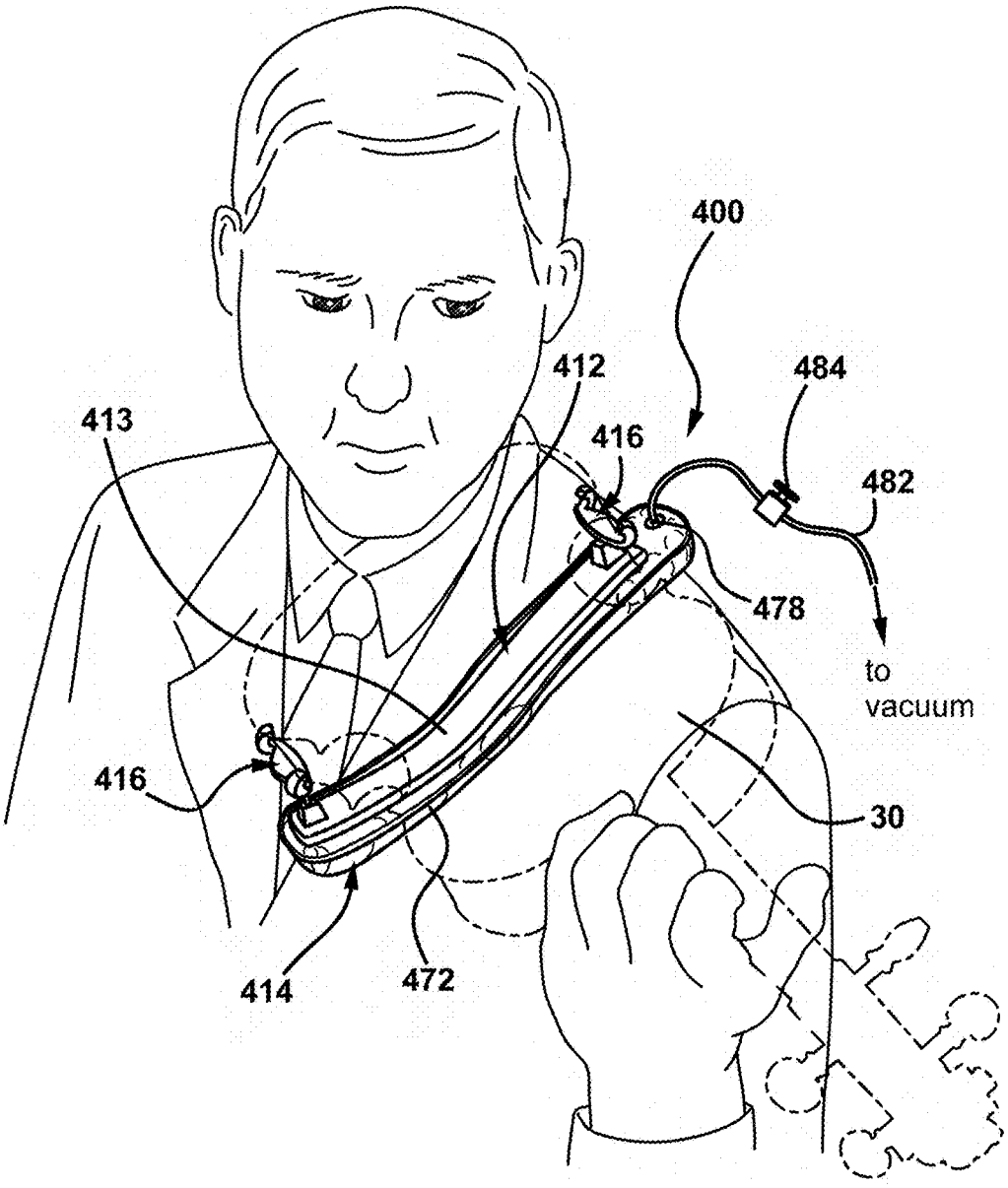
FIG. 20 is a perspective view of the customizable musical instrument support of FIG. 15, undergoing forming of the individually customizable element for use in a customizable musical instrument support.

FIG. 20 illustrates customizable musical instrument support 400 according to an embodiment of the present disclosure undergoing forming of the individually customizable element 414 of an individually customizable musical instrument support. FIG. 20 illustrates a particular example of customizable musical instrument support 400 in a position for forming of an individually customizable element 414 of an individually shaped shoulder rest for a stringed instrument, and further illustrates a particular example in which individually customizable element 414 includes a shape-conforming bag 472 in which the fluid is air. Customizable musical instrument support 400 is positioned between violin 30 (shown in dashed lines in FIG. 20) and the player. Universal component 412 is attached to violin 30 by clamping members 416. More specifically, individually customizable element 414 is positioned between rigid member 413 of universal component 412 and the shoulder and chest area of the player, in order to form individually customizable element 414 to the shape of that part of the player's body beneath and opposed to member 413.

While the shape-conforming bag 472 is in the deformable state, the assembly of the instrument and musical instrument support 400 is adjusted so that the instrument is in a desired playing position and shape-conforming bag 472 conforms to that part of the player's body which it contacts. Port 478 is connected to a vacuum source by tubing 482, in which valve 484 may be provided to control air flow through tubing 482. When the desired position and conformation of musical instrument support 400 is achieved, fluid is removed from the shape-conforming bag (e.g., in FIG. 20 shape-conforming bag 472 is evacuated) to change it to a rigid state. Tubing 482 is then disconnected from port 478, which is closed or sealed, rendering musical instrument support 400 ready for use.

Advantageously, customizable musical instrument support 400, in contrast to various casting methods, may be formed to a customized shape rapidly and without any wet or resinous casting substances contacting or near the individual or instrument. Additionally, if a different position and conformation are desired, the shape-conforming bag may easily be returned to the deformable state by reintroducing fluid to the bag, customizable musical instrument support 400 may be adjusted to a new position and conformation, and fluid may be removed again to render the customizable musical instrument support 400 in the desired different conformation.

Figure 21:
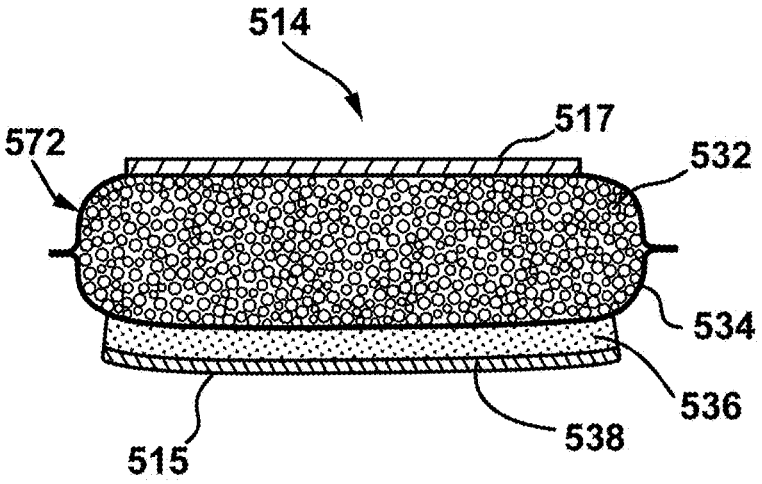
FIG. 21 is a cross-sectional view of a customizable musical instrument support according to an embodiment of the present disclosure, illustrating a violin shoulder rest.

FIG. 21 shows a cross section of an individually customizable element 514 according to an embodiment of the present disclosure having a shape-conforming bag 572, similar, for example, to the individually customizable element 414 illustrated in FIG. 19. Individually customizable element 514 may include a plurality of layers of different materials providing different properties. Individually customizable element 514 may include a granular material 532 contained within an interior layer 534 of a thin, impermeable and flexible material providing the desired properties for shape-conforming bag 572 of controllable rigidity. A portion of layer 534 may be covered by an intermediate layer 536 of a relatively softer and resilient material, operable to provide improved comfort in the course of normal playing motions, and an exterior layer 538 of a fabric, operable to provide a desirable surface texture, durability, or appearance, and provide a surface 515, which is shaped to substantially fit or correspond to the actual contours and surfaces of an individual player during use of the shoulder rest, thereby improving the comfort of the player and the player's control of the instrument. Similar to previously described embodiments, a plate 517 may mate with a corresponding area of a universal component of an instrument rest, providing means for attachment of individually customizable element 514 to a universal component. In still further embodiments, the plurality of layers of individually customizable element 514 may be reversibly attachable to each other, by hook and loop fasteners or other suitable devices, providing the ability, for example, to conveniently reposition the layers relative to each other or to separately clean or replace separate layers.

In still further embodiments, a customizable musical instrument support may include an individually customizable element that may include an enclosed curable material, such that when activated and positioned on a portion of an instrument player's body, the individually customizable element conforms to that part of the instrument player's body.

Advantageously, the customizable musical instrument support including an enclosed curable material, in contrast to various casting methods known in the art, produces molded surfaces without any wet or resinous casting substances contacting the individual or instrument and provides a practical method for producing customized musical instrument supports.

It will be appreciated by those skilled in the art that the techniques of the present disclosure may overcome the drawbacks of conventional adjustment mechanisms (e.g., screws adjustments on clamps) for instruments that inadequately accommodate the range of sizes and body types of different instrument players, and typically are unable to cause the support to fit or correspond to the body contours of an individual player. The various contoured or tailored instruments supports of the present disclosure overcome the problems with conventional instrument supports in which with conventional instruments supports an instrument player may need to adopt a playing position that is uncomfortable or even painful and has less than ideal control of the instrument, resulting in less than ideal quality of the music produced.

It is to be understood that the above description is intended to be illustrative, and not restrictive. For example, the above-described embodiments may be used in combination with each other. In addition, many modifications may be made to adapt a particular situation or material to the teachings of the various embodiments without departing from their scope.

While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled.

In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions, or equivalent arrangements not heretofore described, but which are commensurate with the spirit and scope of the disclosure. Additionally, while various embodiments of the disclosure have been described, it is to be understood that embodiments of the disclosure may include only some of the described embodiments. Accordingly, the disclosure is not to be seen as limited by the foregoing description, but is only limited by the scope of the appended claims.

This written description uses examples in the disclosure, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A customizable musical instrument support, said musical instrument support comprising:

a component releasably attachable to various sized single-type musical instruments, said component comprising:

a rigid structural portion having a surface disposable adjacent to a musical instrument player's body in proximity to placement of said individually customized musical instrument support on the musical instrument player during playing of the musical instrument; and means for releasably attaching said rigid structural portion to various sized single-type musical instruments;

at least one shape-conforming bag of controllable rigidity comprising an impermeable and flexible material containing a free-flowing granular material and a fluid;

a port operably attached to said bag to allow flow of fluid into or out of said bag;

a valve for operable sealing fluid in said bag;

said bag attached to said component;

said bag comprising a customizable surface shapeable to substantially conform to a portion of the musical instrument player's contoured body surface which is in proximity to placement of said customized musical instrument support on the musical instrument player during playing of the musical instrument;

said bag is changeable from a moldable state into a generally rigid state by removing fluid from the bag to retain the conformation of the customizable surface of the bag to the portion of the instrument player's contoured body surface; and wherein the customizable musical instrument support comprises a chin rest or a shoulder rest.

2. The customizable musical instrument support of claim 1 wherein said at least one shape-conforming bag is reversibly changeable between said moldable state and said generally rigid state by removing fluid from or introducing fluid to said bag.

3. The customizable musical instrument support of claim 1 wherein said customizable musical instrument support comprises the shoulder rest.

4. The customizable musical instrument support of claim 1 wherein said customizable musical instrument support comprises the chin rest.

5. The customizable musical instrument support of claim 1 further comprising at least one cover layer disposed on at least a portion of said customizable surface of said bag.

6. The customizable musical instrument support of claim 5 wherein said at least one cover layer comprises an intermediate layer and an exterior layer.

7. The customizable musical instrument support of claim 6 wherein said intermediate layer comprises a first material and said exterior layer comprises a second material different from said first material.

8. The customizable musical instrument support of claim 7 wherein said intermediate layer and said exterior layer are releasably attachable to each other.

9. The customizable musical instrument support of claim 8 wherein said intermediate layer is releasably attachable to said bag.

10. The customizable musical instrument support of claim 9 wherein said intermediate layer and said exterior layer are repositionable relative to each other, and to said customizable surface of said bag.

11. The customizable musical instrument support of claim 6 wherein said intermediate layer comprises a soft resilient material.

12. The customizable musical instrument support of claim 6 wherein said exterior layer comprises a fabric material.

13. The customizable musical instrument support of claim 1 further comprising means for releasably attaching said component to said bag.

14. The customizable musical instrument support of claim 1 further comprising a plate having a first portion attached to said bag and a second portion attached to said component.

15. The customizable musical instrument support of claim 1 further comprising a second port operable to allow granular material to be added to or removed from said bag.

16. The customizable musical instrument support of claim 1 wherein said granular material comprises thermoplastic beads.

17. The customizable musical instrument support of claim 1 wherein said fluid comprises air.

18. The customizable musical instrument support of claim 1 wherein said customizable musical instrument support comprises the shoulder rest, and wherein said means for releasably attaching said rigid structural portion to various sized single-type musical instruments comprises means for adjusting an offset distance of each end said customizable shoulder rest relative to a bottom of the instrument, means for adjusting a position between clamping members, and/or means for attaching said customizable shoulder rest along a range of positions on the instrument.

19. A method comprising:

providing the customizable musical instrument support of claim 1;

attaching the customizable musical instrument support to a musical instrument;

adjusting the assembly of the musical instrument and the customizable musical instrument support such that the musical instrument is in a playing position and a surface of the shape-conforming bag contacts and conforms to a portion of a musical instrument player's body; and removing fluid from the bag to change the bag to a generally rigid state to retain the conformation of the customizable surface of the bag to the portion of the instrument player's contoured body surface.

20. The method of claim 19 further comprising, after initial adjustment of the assembly of the musical instrument and the customizable musical instrument support, removing a portion of the fluid from the bag to change the bag to an intermediate moldable state and refining the conformation of the customizable surface of the bag to the player's body.

21. The method of claim 19 further comprising closing the valve to seal the bag after fluid is removed from the bag to change the bag to the generally rigid state.

22. The method of claim 19 further comprising, after fluid is removed from the bag to change the bag to the generally rigid state, reintroducing fluid to the bag to return the bag to a conformable state, readjusting the assembly of the musical instrument and the customizable musical instrument support such that the musical instrument is in a playing position and a surface of the shape-conforming bag contacts and conforms to a portion of a musical instrument player's body, and removing fluid from the bag to change the bag to a generally rigid state to retain the readjusted conformation of the customizable surface of the bag to the portion of the instrument player's contoured body surface.

23. A customizable musical instrument support, said musical instrument support comprising:

a component releasably attachable to various sized single-type musical instruments;

at least one shape-conforming bag attached to said component, said bag comprising an impermeable and flexible material containing a free-flowing granular material and a fluid;

said bag comprising a customizable surface shapeable to substantially conform to a portion of the musical instrument player's contoured body surface which is in proximity to placement of said customized musical instrument support on the musical instrument player during playing of the musical instrument;

said bag is changeable from a moldable state into a generally rigid state by removing fluid from the bag to obtain an impression of the portion of the instrument player's contoured body surface; and wherein the customizable musical instrument support comprises a chin rest or a shoulder rest.

* * * * *